US008002486B1

(12) United States Patent
Tran

(10) Patent No.: US 8,002,486 B1
(45) Date of Patent: Aug. 23, 2011

(54) BATH SPONGE WITH BUILT-IN SOAP DISPENSER

(76) Inventor: Hong D. Tran, Rancho Cordova, CA (US)

( * ) Notice: Subject to any disclaimer, the term of this patent is extended or adjusted under 35 U.S.C. 154(b) by 977 days.

(21) Appl. No.: 11/875,000

(22) Filed: Oct. 19, 2007

(51) Int. Cl.
*B43K 5/00* (2006.01)

(52) U.S. Cl. ..... 401/206; 401/205

(58) Field of Classification Search ..... 401/6, 186, 401/196, 202, 205, 206, 263, 270, 278, 279
See application file for complete search history.

(56) References Cited

U.S. PATENT DOCUMENTS 4,183,684 A * 1/1980 Avery, Jr. ..... 401/133
5,944,032 A * 8/1999 Masterson ..... 401/183

* cited by examiner

*Primary Examiner* — Tuan N Nguyen

(57) ABSTRACT

A bath sponge that is equipped with a built-in soap dispenser constructed of a sponge body that has a first cavity on one side, and a handle portion that has a second cavity for holding a quantity of liquid soap that may be in fluid communication with the first cavity when a gate is opened by operating a push button gate release device.

7 Claims, 4 Drawing Sheets

BATH SPONGE WITH BUILT-IN SOAP DISPENSER

FIELD OF THE INVENTION

The present invention generally relates to a bath accessory and more particularly, relates to a bath sponge that is equipped with a built-in soap dispenser in fluid communication with the sponge.

BACKGROUND OF THE INVENTION

Bathroom accessories for aiding a person taking a bath or shower are abundant. One of such popular accessories is a bath sponge for use in helping to scrub the body. When using the bath sponge, a liquid soap is frequently used in conjunction such that the body can be lathered up and scrubbed with the bath sponge. However, holding a bath sponge in one hand while holding a bottle of liquid soap in the other is not a very convenient way of taking a bath or shower. It would be desirable to have a bath sponge that can automatically dispense a liquid soap while being used such that the necessity of using a separate bottle of soap is eliminated.

It is therefore an object of the present invention to provide a bath sponge that does not have the drawbacks or shortcomings of the conventional bath sponge.

It is another object of the present invention to provide a bath sponge that is equipped with a built-in soap dispenser which can be filled with liquid soap.

It is a further object of the present invention to provide a bath sponge with a built-in soap dispenser and an activation switch to release the soap when desired.

SUMMARY OF THE INVENTION

In accordance with the present invention, a bath sponge that is equipped with a built-in soap dispenser is disclosed.

In a preferred embodiment, the present invention bath sponge with a built-in soap dispenser can be provided in a sponge body that has a first cavity on one side and a periphery surrounding and defining the cavity; and a handle portion that has an outside contour for gripping by a human hand, the handle portion has a second cavity therein for receiving a quantity of liquid soap, an opening at a bottom surface in fluid communication with the first cavity in the sponge body, a peripheral surface surrounding the opening sealingly joined to the periphery of the sponge body, a gate operable for opening/closing the opening at the bottom surface, a gate-release button for operating the gate, and a sealable aperture in fluid communion with the second cavity for filing the second cavity with a liquid soap.

BRIEF DESCRIPTION OF THE DRAWINGS

The invention will now be described, by way of example, with reference to the accompanying drawings, in which.

DETAILED DESCRIPTION OF THE PREFERRED EMBODIMENT

The present invention discloses a bath sponge that is equipped with a built-in soap dispensing for use in a bath or in a shower.

The present invention bath sponge is a new type of bath sponge that includes a built-in soap dispenser. It is easier and more effective to use than standard methods of cleansing the body. The soap dispenser consists of a bath sponge, that measures about 6 inches high, 6 inches long, and 6 inches wide, that is attached to a hollow plastic handle. A spring-loaded release button located at the top of the handle can be used to release a liquid bath soap onto the sponge.

For use, a person simply fills the handle with a liquid soap. The user can then press the button located at the top of the handle to release soap onto the sponge. The bath sponge forms a lather to more effectively and conveniently cleanse the body. The specially designed bath bathing tool eliminates the need to continuously reapply bath gel to a sponge, and it makes bathing more convenient and enjoyable. It provides a person with a quick easy way to cleanse his or her body for overall comfort and hygiene and without strain. The present invention bath sponge can be produced in a wide variety of sizes and colors to match the decor of any bathroom.

The present invention bath sponge fulfills the need for a self-soaping bath care product that allows a person to cleanse his or her body with ease. The appealing features of the present invention bath sponge are its ease of use, convenience, effectiveness, lightweight, compact size, portability, practicality, eye-catching design, and novelty. The personal care product eliminates the use of traditional bath sponges and a separate bottle of liquid soap of bath gel to cleanse the body. Bath gel needs to be continuously reapplied to sponges and washcloths when bathing. With the present invention self-soaping bath sponge, a person can simply push a button to release onto his sponge. It eliminates the time consuming hassle of constantly picking up a liquid soap bottle to reapply gel to his sponge. The present invention self-soaping product is a more effective alternative to standard sponges and separate liquid soaps that is especially appealing to individuals who have tired of conventional tools. It saves the user a considerable amount of time and effort while bathing or showering.

Figure 1:
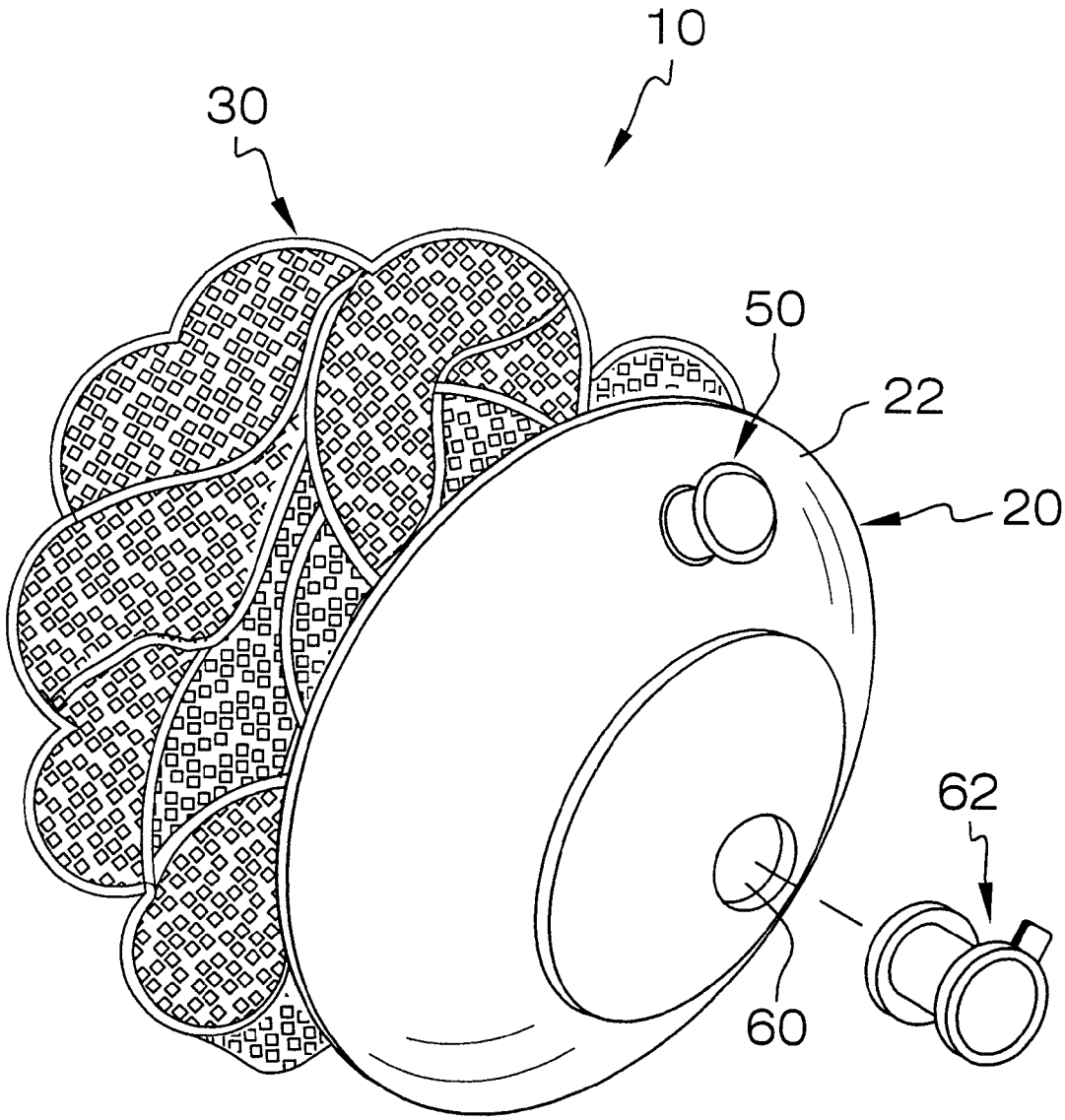
FIG. 1 is a perspective view of a present invention bath sponge with a built-in soap dispenser.
Figure 3:
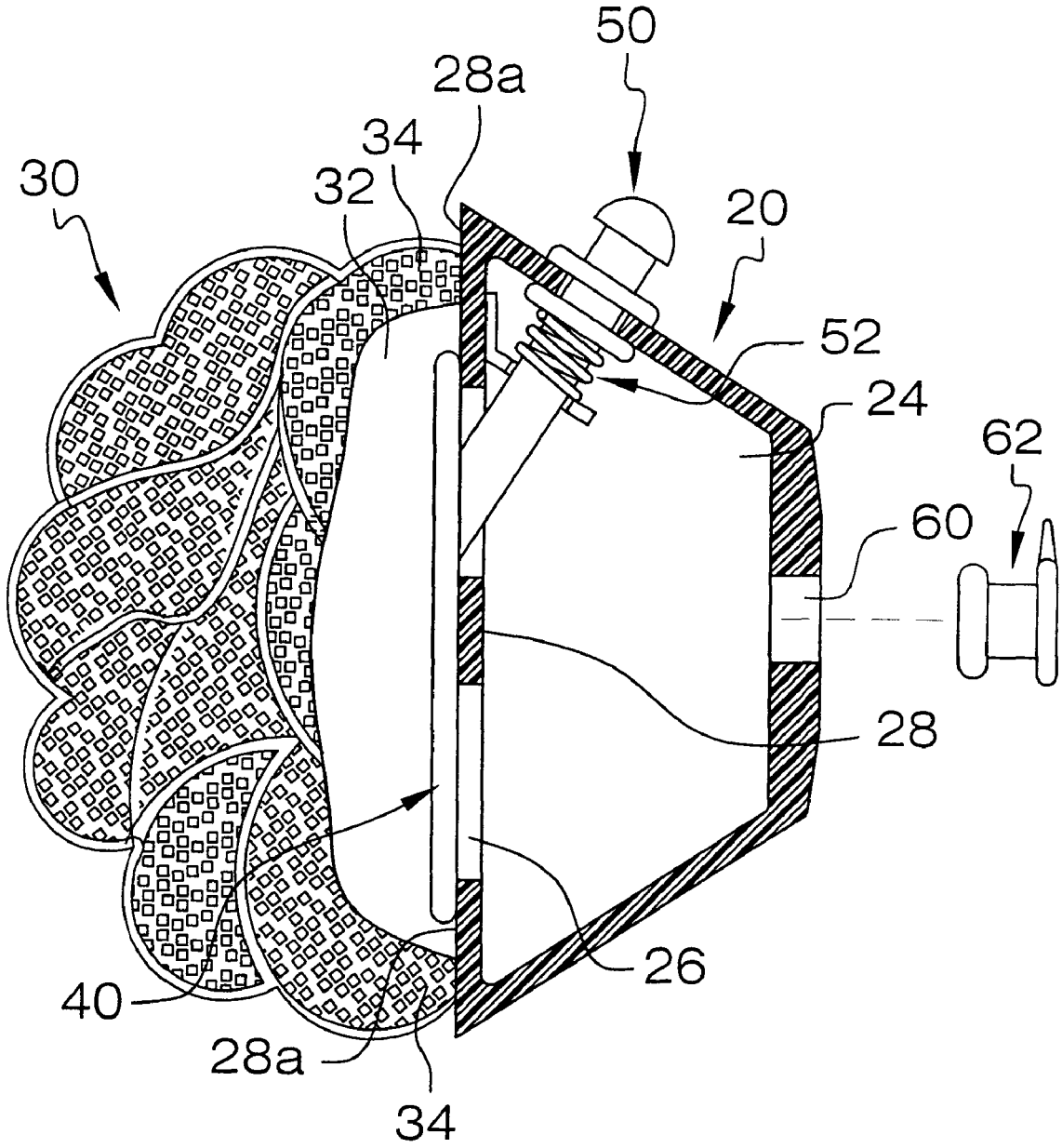
FIG. 3 is a cross-sectional view of the present invention bath sponge with a built-in soap dispenser.
Figure 4:
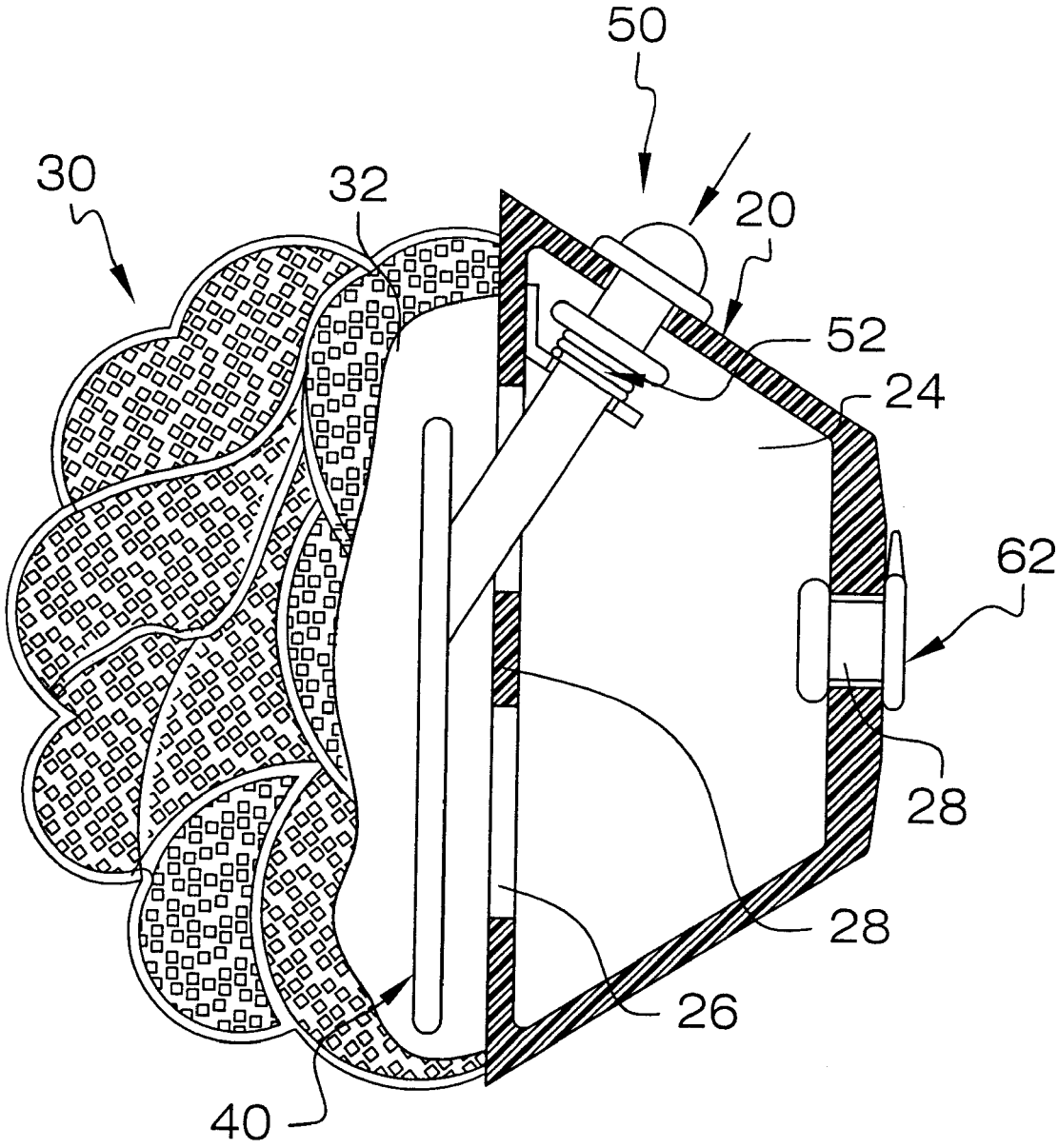
FIG. 4 is a cross-sectional view of the present invention bath sponge with a built-in soap dispenser wherein a soap dispensing gate is opened.

Referring initially to FIG. 1, wherein a perspective view of the present invention bath sponge 10 that is equipped with built-in soap dispenser 20 is shown. The bath sponge 10 is constructed of a sponge body 30 which has a first cavity 32 (shown in FIG. 3) on one side and a periphery 34 surrounding and defining the cavity 32. The bath sponge 10 further comprising a handle portion, i.e. the soap dispenser 20 which has an outside contour 22 for gripping by a human hand, the handle portion 20 has a second cavity 24 therein for receiving a quantity of liquid soap (not shown). An opening 26 at a bottom surface 28 in fluid communication with the first cavity 32 of the sponge body 30. A peripheral surface 28*a* surrounding the opening 26 sealingly joined to the periphery 34 of the sponge body 30. A gate 40 is operable for opening/closing the opening 26 at the bottom surface 28. A gate release button 50 that is spring-loaded by spring 52 is used for operating the gate 40, i.e. when the button 50 is pushed down against the spring 52, the gate 40 disengages from the opening 26, as shown in FIG. 4, and thereby allows liquid soap inside cavity 24 to enter into cavity 32 in the sponge body 30 and thus allowing the sponge body 30 to be lathered up.

Figure 2:
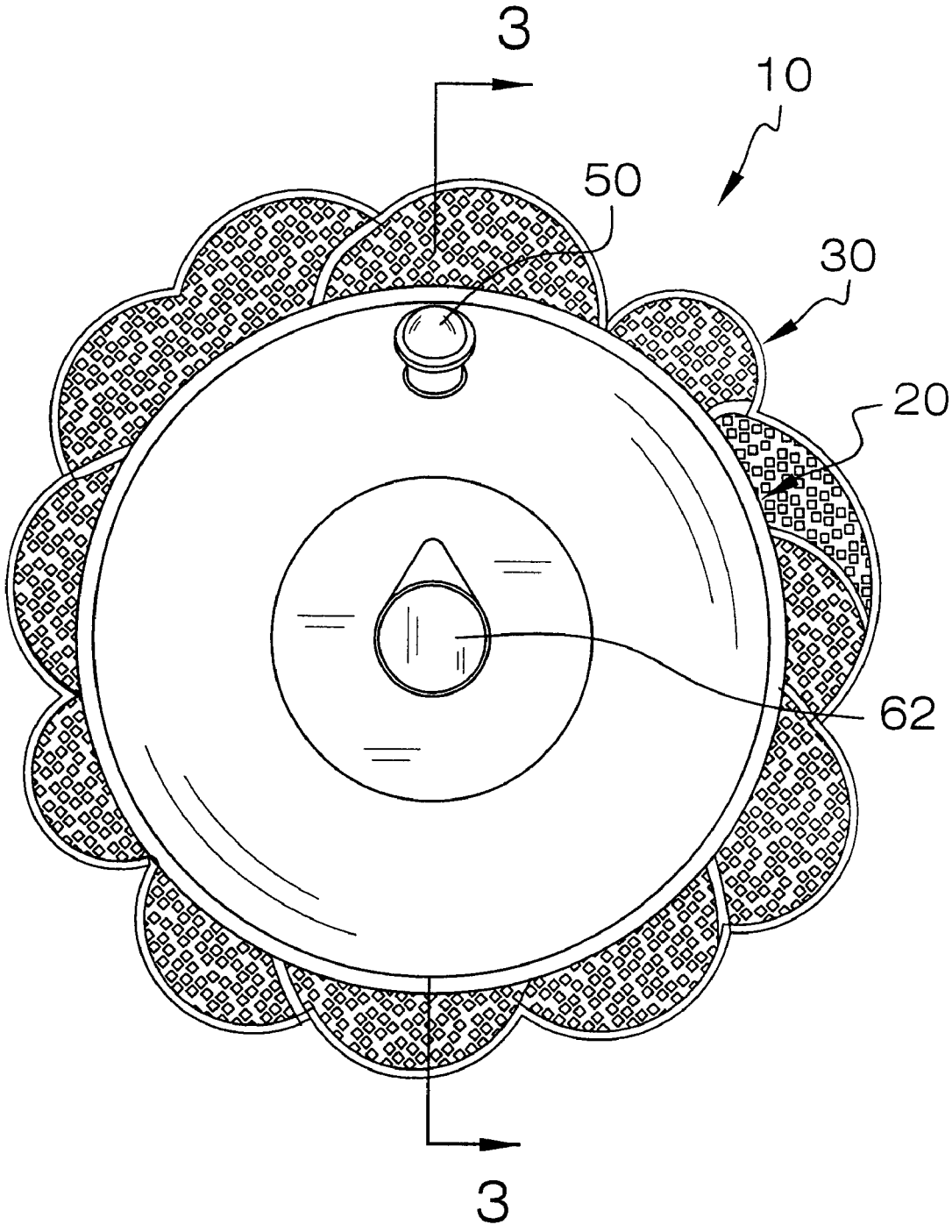
FIG. 2 is a top view of the present invention bath sponge with a built-in soap dispenser.

The present invention handle portion, i.e. soap dispenser 20 further includes an aperture 60 which is in fluid communication with the second cavity 24 for filing the second cavity with a liquid soap when necessary. The aperture 60 is normally plugged with a removable cap 62 as shown in FIGS. 1-4. It should be noted that FIG. 2 shows a top view of the present invention bath sponge 10.

The present invention bath sponge equipped with a built-in soap dispenser has therefore been amply described in the above descriptions and in the appended drawings of FIGS. 1-4.

While the preferred embodiments of the invention have been described above, it will be recognized and understood that various modifications can be made in the invention and the appended claims are intended to cover all such modifications which may fall within the spirit and scope of the invention.

What is claimed is:

1. A bath sponge with a built-in soap dispenser comprising:

a sponge body having a first cavity on one side and a periphery surrounding and defining said cavity; and a handle portion having an outside contour for gripping by a human hand, said handle portion having a second cavity therein for receiving a quantity of liquid soap, an opening at a bottom surface in fluid communication with said first cavity in the sponge body, a peripheral surface surrounding said opening sealingly joined to said periphery of said sponge body, a gate operable for opening/closing said opening at the bottom surface, a gate-release button for operating said gate, and a sealable aperture in fluid communion with said second cavity for filing said second cavity with a liquid soap.

2. The bath sponge with a built-in soap dispenser according to claim 1, wherein said sponge body further comprising a nylon net surrounding an outside surface of the sponge.

3. The bath sponge with a built-in soap dispenser according to claim 1, wherein said sponge body is formed of an open-cell sponge.

4. The bath sponge with a built-in soap dispenser according to claim 1, wherein said handle portion is formed of a plastic material.

5. The bath sponge with a built-in soap dispenser according to claim 1, wherein said handle portion further comprising a plug member for sealingly engaging the aperture in the handle portion.

6. The bath sponge with a built-in soap dispenser according to claim 1, wherein said handle portion is generally of a semi-spherical shape.

7. The bath sponge with a built-in soap dispenser according to claim 1, wherein said bath sponge has a dimension of about 6 inches high, 6 inches wide, and 6 inches deep.

* * * * *